US005720188A

United States Patent [19]

Leeke et al.

[11] Patent Number: 5,720,188

[45] Date of Patent: Feb. 24, 1998

[54] KNITTED COVER HAVING COURSE-WISE SLIT

[75] Inventors: Gray John Leeke, Southfield; Brandon David Runnels, White Lake, both of Mich.

[73] Assignee: General Motors Corporation, Detroit, Mich.

[21] Appl. No.: 603,297

[22] Filed: Feb. 20, 1996

[51] Int. Cl.[6] ..... D04B 7/04

[52] U.S. Cl. ..... 66/196; 66/169 R; 66/172 R

[58] Field of Search ..... 66/169 R, 170, 66/172 R, 198, 60 R, 173, 196, 174, 171, 179, 182, 189, 190, 199, 201, 64, 65, 75.1; 297/218.3, 218.5, 218.4; 2/202, 204, 205, 162, 161.1, 161.2

[56] References Cited

U.S. PATENT DOCUMENTS

| | | | |
|---|---|---|---|
| 2,006,465 | 7/1935 | Lieberknecht | 66/173 |
| 2,973,762 | 3/1961 | Koenig | 66/170 |
| 3,875,768 | 4/1975 | Arndt | 66/172 R |
| 5,308,141 | 5/1994 | Robinson et al. | 297/218 |
| 5,326,150 | 7/1994 | Robinson et al. | 297/218 |
| 5,361,607 | 11/1994 | Mitsumoto et al. | 66/173 |

FOREIGN PATENT DOCUMENTS

| | | |
|---|---|---|
| 1420231 | 1/1976 | United Kingdom . |
| 1445506 | 8/1976 | United Kingdom . |
| 2251001 | 6/1992 | United Kingdom . |

*Primary Examiner*—C. D. Crowder
*Assistant Examiner*—Larry D. Worrell, Jr.
*Attorney, Agent, or Firm*—George A. Grove

[57] ABSTRACT

A double jersey weft knitted fabric cover having a course-wise slit formed therein and at least one edge of the slit extending into an overlapping portion, preferably of single jersey fabric, which overlaps the other edge, and a method of knitting the same using a weft knitting machine having two independently operable needle beds.

21 Claims, 3 Drawing Sheets

KNITTED COVER HAVING COURSE-WISE SLIT

This invention relates to knitted fabric covers having a slit deliberately provided in the cover to allow a belt, tape or other elongate object to pass through, and a method of forming such a cover.

BACKGROUND OF THE INVENTION

The invention is useful in machine knitting on weft knitting machines having independently operable needles displaced in two needle beds, for example, a flat "V" bed machine producing mainly double jersey structure fabric.

It has recently been found possible to knit one-piece upholstery covers which removes the need for sewing portions of the cover together. In U.S. Pat. Nos. 5,308,141 and 5,326,150, a method for knitting one-piece covers for the base and/or back cushions of a motor vehicle seat is disclosed.

Motor vehicle seat covers and/or trim panel covers may require that provision be made in the cover for the passage therethrough of a belt. In particular, for vehicle seats there may be a requirement for a safety belt to pass through the cover for anchoring to the seat frame or, in the case of a trim panel, anchoring to the vehicle chassis.

OBJECT OF INVENTION

The present invention provides a knitted cover and a method of machine knitting a cover, containing provision for passage of a seat belt.

SUMMARY OF THE INVENTION

According to the present invention, there is provided a cover for an object, the cover comprising double jersey weft knitted fabric having at least one course-wise slit formed in the fabric, at least one edge of the slit extending into an overlapping portion comprising further courses which overlaps the other edge of the slit. The overlapping portion helps to hide the object within the cover from a viewer so that the object cannot readily be seen.

A single jersey fabric, namely a fabric which can be produced on a single row of needles, has a technical face side which is produced in contact with the needle bed and a technical reverse side which is away from the needle bed. Where such a fabric is produced on a V-bed machine, the technical reverse side of the fabric is the side of the fabric nearer the center line of the V-bed. In conventional knitted garment production, the technical face of the fabric is the face seen by the user and/or normally the face on the exterior of the garment.

A double jersey structure, by comparison, is produced on both beds of a V-bed knitting machine and has in effect a pair of faces interconnected by inter-engaging loops of knitting. It will be appreciated, therefore, that double jersey structures tend to be heavier in weight than single jersey structures.

The application of the present invention uses both single jersey and double jersey knitting techniques.

Preferably, the overlapping portion in the region of the slit comprises a plurality of courses of single jersey knitting. The course-wise slit may be formed through aligned courses of both double jersey layers. In one of said layers, the two edges of the slit extend into a pair of single jersey flaps which can be pushed through the slot formed in the outer layer.

Alternatively, the course-wise slit may be formed in aligned courses of both double jersey layers, the two edges of the slit each extending as a pair of flaps of single jersey tube construction, which flaps can be pushed through the slit.

In yet another embodiment, the cover includes a single jersey tubular portion formed integrally with the double jersey cover. At least one end of the single jersey tubular portion constitutes an edge of said course-wise slit. Preferably, said end of the tubular single jersey portion opens to one face of the double jersey fabric and the other end of the tubular single jersey portion opens to the other face of the double jersey fabric, said overlapping portion being at said one end of the tubular portion and being capable of being rocked within the tube portion.

In a further embodiment, the overlapping portion is a double jersey portion, and there is a second course-wise slit aligned with the first slit and spaced several courses therefrom and which also has one edge which extends into a double jersey overlapping portion which can overlap the first overlapping portion.

Also according to the invention, there is a provided a method of forming a course-wise slit in a weft knitted fabric cover which is knitted on a weft knitting machine having needles displaced in at least two independently operable needle beds. The fabric is knitted on both needle beds in mainly double jersey construction. At a predetermined course at least one selected group of consecutive needles on one or both needle beds continue to knit with other needles on each side thereof held up and thereby form a flap. Knitting then recommences on both needle beds to continue the double jersey construction from said predetermined course.

Preferably said group of needles is pressed off after knitting a plurality of courses to form said flap. Conveniently, said selected group of needles on both needle beds continue knitting from said predetermined course said flap as a double jersey construction flap, said group of needles picking up stitches on recommencing knitting from said predetermined course.

Preferably on recommencing knitting, the needles on both needle beds knit double jersey fabric up to a second predetermined course where stitches on both groups of needles are pressed off. Both groups of needles then pick up new stitches and knit a plurality of courses while the needles on each side of said groups are held up to form a second flap, and then continuing to knit on all the needles after formation of said second flap.

Alternatively, said fabric is knitted with said selected group of needles forming a single jersey tubular portion. At the predetermined course, said group of needles on one needle bed only continues to knit to form a single jersey construction flap with said other needles held up.

In a further embodiment, at said predetermined course said selected group of needles on both needle beds continues to knit a single jersey tube to form a single jersey tubular loop, which is subsequently separated along a course line to form a pair of single jersey tubular flaps with open ends.

In yet another embodiment, at said predetermined course for said group of needles the stitches on one needle bed are dropped off and/or transferred to the other needle bed, and a single jersey loop is formed by knitting on said group of needles on the other needle bed, which loop is subsequently severed along a course line to form a pair of single jersey flaps.

The knitted fabric is knitted from a multi-filament yarn, preferably a polyester yarn which may be air texturized. The yarn may be chenille yarn. The chenille yarn may have a decitex in the range 1500 to 3000, and the ground yarn has a decitex in the range 550 to 900, conveniently there being in the range 8 to 16 wales per inch (2.54 cm) in a course-wise direction, and in the range 8 to 30 courses per inch in the wale-wise direction, the chenille yarn being knitted into the fabric as knitted looped stitches.

The ground yarn is preferably an air-textured polyester yarn having a decitex in the region 550 to 900 or 600 to 800 or 600 to 750 or 650 to 700 decitex. The chenille yarn may be formed of a pair of twisted nylon and/or polyester strands trapping therebetween a pile. The pile may be bonded to the strands, for example by the use of a low-melting point nylon strand, or the pile may be moveable relative to the strands.

The chenille yarn may have a count in the range 1500 to 3000 decitex. The chenille yarn is preferably one having moveable pile and/or an extensible core.

Preferably, the air texturized polyester yarns are continuous filaments yarns having a count, in the unrelaxed state, of 680 to 750 decitex.

Preferably, the method of knitting is such that, in the relaxed state, the fabric has from 4 to 6 wales per cm.

The fabric may be knitted on a flat bed knitting machine having a pair of opposed needle beds. The machine may have a gauge in the range 10 to 16, preferably 10 to 14, further preferably 12.

The machine may be a twin cam machine or a three cam or four cam machine.

The present invention preferably provides a method of knitting a cover, preferably an upholstery fabric, in which the knitting is carded out on a machine having a pair of opposed independently operable needle beds and in which the needles in each bed can be moved independently of one another in that bed into the path of an operating cam box reciprocating along the needle beds.

An upholstery fabric for a vehicle seat preferably has a weight in the relaxed state ready for use in excess of 500 $g/m^2$ preferably 500 to 900 $g/m^2$. This compares to traditional knitted products which have a weight of 300–350 $g/m^2$.

Preferably, the upholstery fabric is a weft knitted upholstery fabric formed of yarn having a decitex in the range 625 to 850 and having been knitted on a machine having a machine gauge in the range 10 to 18, the fabric being of generally double jersey construction having inter-engaging loops between portions of the double jersey structure.

The knitted fabric may be a three-dimensional cover for use on a three-dimensional structure to form an upholstered structure.

The fabric may be formed of two or more different colored yarns.

BRIEF DESCRIPTION OF THE DRAWINGS

The invention will be described by way of example and with reference to the accompanying drawings in which.

DESCRIPTION OF PREFERRED EMBODIMENTS

Figure 1:
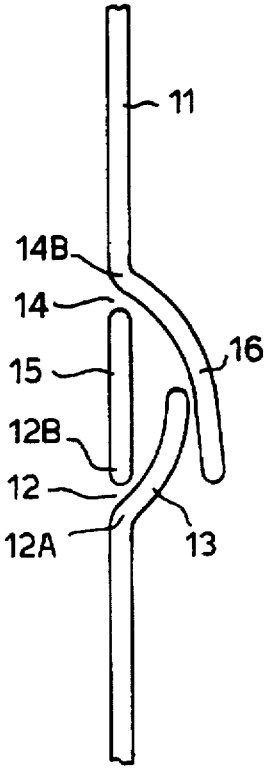
FIGS. 1 and 2 show a first knitted fabric according to the present invention.

Referring to the drawings, each set of drawings constitutes a schematic plan view and a cross-sectional side view through a course-wise slit formed in a fabric portion 11 forming part of an automobile seat cover which is continuously weft knitted in a single operation. The fabric cover is of mainly double jersey construction and is knitted on a flat "V" bed knitting machine provided with a conventional presser foot device and/or other loop hold down device for holding down the knitted fabric between the opposed needle beds of the machine. The direction of knitting in each set of drawings is in the direction of arrow "A", that is, from the bottom to the top of each drawing so that wales of fabric pieces extend vertical upwardly in each diagram and the courses extend horizontally in each diagram.

The knitting of a complete seat cover is described in detail in U.S. Pat. Nos. 5,308,141 and 5,326,150 and therefore will only be described herein so as to give an understanding of the present invention.

Figure 2:
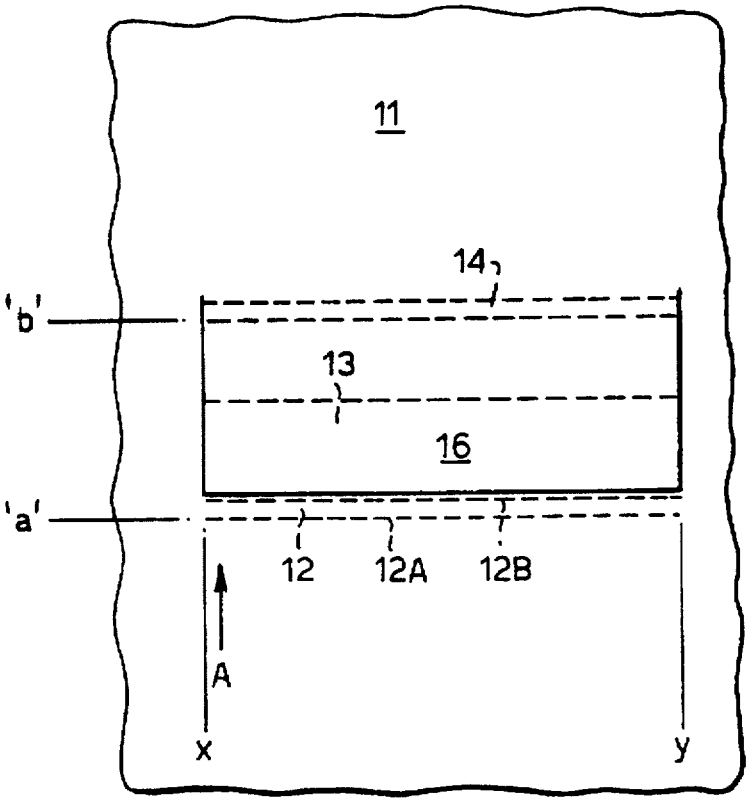

Referring to FIGS. 1 and 2, there is shown a portion 11 of a seat cover which is substantially formed from a double jersey weft knitted fabric. The fabric portion 11 is formed with course-wise slit 12 thereon to permit the passage through the fabric of a belt or webbing or other elongate member. The lower edge **12*a* of the slit 12 extends into a flap 13 comprising a plurality of courses of double jersey knitting. The flap 13 overlaps the other edge 12B of the slit 12**.

A second course-wise slit 14 is located in the double jersey fabric 11 in alignment with the first slit 12 so that there is a band 15 of double jersey fabric several courses wide between the two slits. A second flap 16 extends from the upper edge 14B of the second slit 14 and is of a sufficient number of courses to substantially cover the first flap 13.

The fabric cover including the portion 11 is knitted on two independent needle beds and is knitted in double jersey structure up to a predetermined course "a". On reaching course "a", the needles to the left of the needle line x and to the right of needle line y are held up, and the group of consecutive needles between needles x and y continue to knit on both needle beds for few courses (about 10 to 12 courses) to form the flap 13. The stitches on the needles x–y on both needle beds are then pressed off.

The needles between x–y (on both needle beds) then pick up new loops to form set-up courses, and all the needles then continue to knit for about another 20–25 courses up to course "b".

At course "b" the stitches on needles x–y on both beds are pressed off and then picked up again to form set-up courses and knit a plurality of courses, about 25–30 courses, while the needles outside of x and y are held up. This forms the second flap 16. Thereafter, all the needles on both beds knit to form the remainder of the double jersey fabric.

Figure 3:
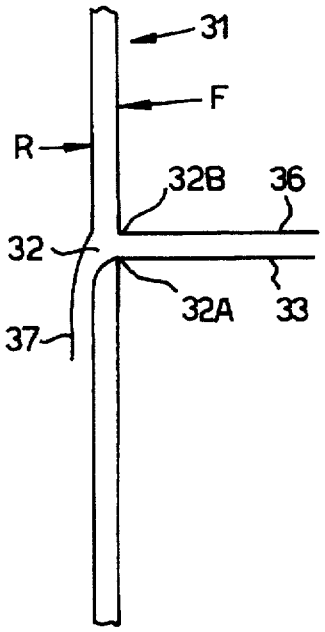
FIGS. 3 and 4 show a second knitted fabric according to the present invention.
Figure 4:
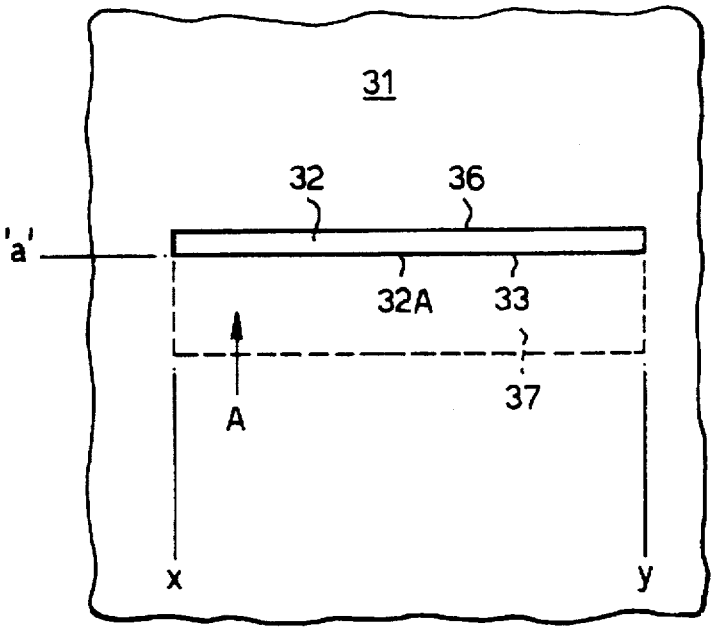

Referring to FIGS. 3 and 4, there is shown a portion 31 of a seat cover of double jersey weft knitted fabric having a course-wise slit 32 formed therein.

On one face F of the fabric, the upper and lower edges 32A and 32B of the slit 32 each extend into a single jersey construction flap 33 and 36, respectively. On the rear face R of the fabric, the upper edge 32B of the slit 32 extends into a small single jersey construction flap 37. The two flaps 33 and 36 can be tucked back through the slit 32 to form neater, more aesthetically pleasing edges to the slit 32.

As before, the material of the fabric is formed by double jersey weft knitting on all needles up to course "a".

On reaching course "a", the needles outside of the needles x and y are held up, and the needles on the rear needle bed between x and y are pressed off and preferably the last course contains a fusible thread. The needles on the front needle bed between needles x and y continue to knit a single jersey construction loop for about 40 courses. After about 30 courses have been knitted on the front bed, the rear bed needles between x and y begin to knit the single jersey flap 37 for about 10 courses. The needles on both beds then recommence knitting the double jersey fabric structure. This results in the formation of a double jersey structure having the slit 32 with a single jersey loop on the face F. This construction is similar to that described in U.S. Pat. Nos. 5,308,141 and 5,326,150. The loop can then be severed either by cutting or by inclusion of a couple of courses of a friable thread during knitting of the single jersey flaps 33, 36.

Figure 5A:
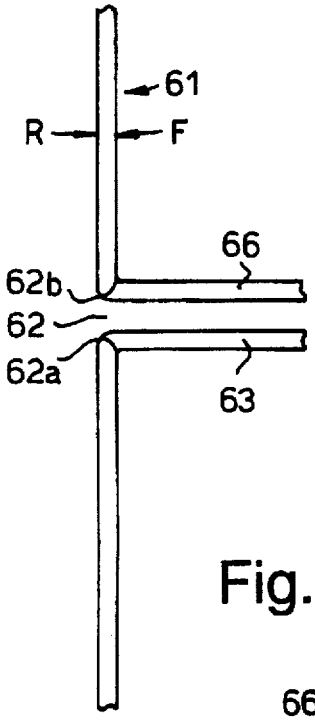
FIGS. 5A and 6 show a third knitted fabric according to the present invention.
Figure 5B:
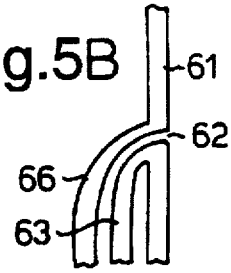
FIG. 5B shows a portion of the view of FIG. 5A in which knitted falps have been pushed through the knitted slit.
Figure 6:
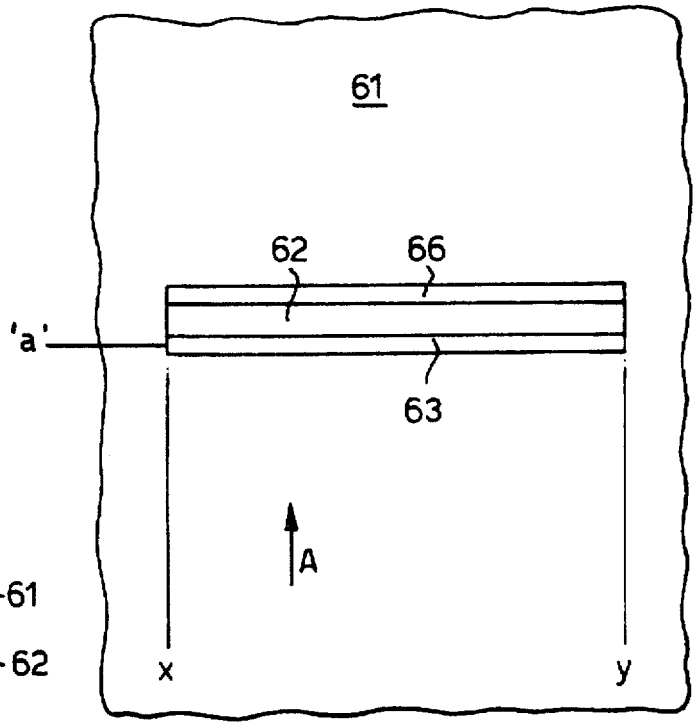

Referring to FIGS. 5A and 6, as before a double jersey weft knitted fabric 61 has a course-wise slit 62 formed therein. The top and bottom edges **62*b* and 62*a* respectively of the slits 62 each have a single jersey tubular flap 63, 66 extending therefrom on the front face F. The two tubular flaps can be folded back through the slit 62 to the rear of the fabric as shown in FIG. 5B** to present a more aesthetic front face F.

As before, the double jersey structure fabric is knitted on all needles on both needle beds up to course "a". At course "a", the needles outside of needles x and y are held up, while the needles between x and y continue to knit a single jersey tubular construction for about 50–60 courses. Thereafter, all needles then recommence knitting double jersey fabric from course "a" onwards.

The single jersey tubular loop may be severed as before, that is, cut, or by the inclusion of a couple of courses of friable thread incorporated therein, to produce two single jersey tubular flaps 63, 66. The flaps 63, 66 are again pushed through the slit. In order to help the flap to pass through the slit 62, the flap can be biased in that direction by knitting extra courses on the front face relative to the back face to bias the flap.

Figure 7A:
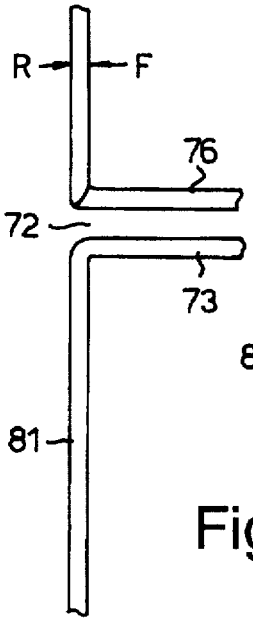
FIGS. 7A and 8 show a further embodiment of the invention.
Figure 7B:
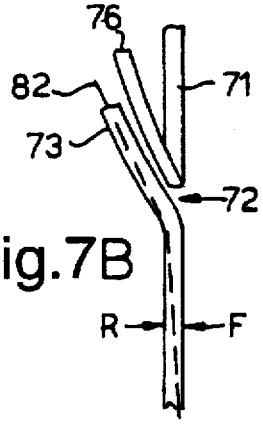
FIG. 7B shows a portion of the view of FIG. 7A in which knitted flaps have been pushed through the knitted slit.
Figure 8:
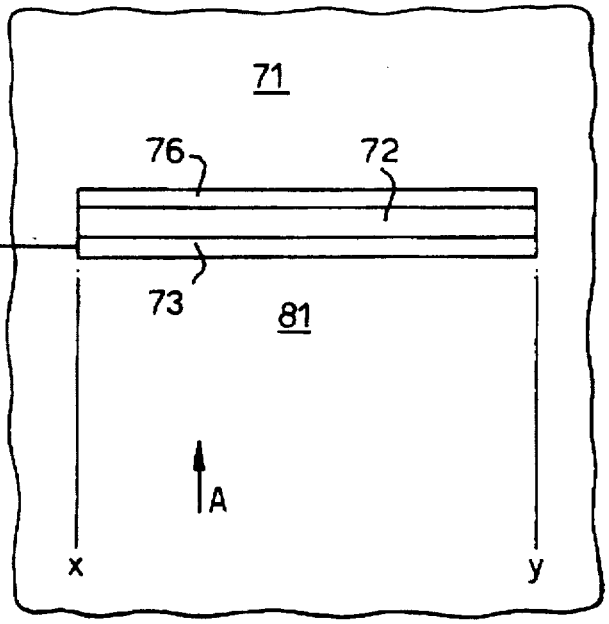

Referring to FIGS. 7A and 8, the substantially double jersey fabric 71 is knitted with an integral single jersey tubular portion 81 extending the full course-wise width of the slit and located adjacent the lower edge of the course-wise slit 72. The bottom edge **72*a* of the slit extends into a single jersey tubular flap 73. The upper edge 72*b* of the slit 72 also extends into a single jersey tubular flap 76. The two flaps 73, 76 are shown extending from the front face F of the fabric and can be pushed back through the slit 72 as shown in FIG. 7B. A belt or webbing 82 shown in dotted line could pass through the single jersey flap 73 and tubular portion 81**.

The double jersey fabric 71 is knitted with a single jersey tubular portion 81 formed on the needles between x and y. On reaching course "a", the needles outside of needles x and y are held up. The needles on both sets between x and y continue to knit as single jersey tubes as before for FIGS. 5A and 6. Thereafter, all the needles recommence knitting the double jersey fabric from course "a" onwards.

The flaps 73, 76 are made as in FIGS. 5A and 6.

Figure 9A:
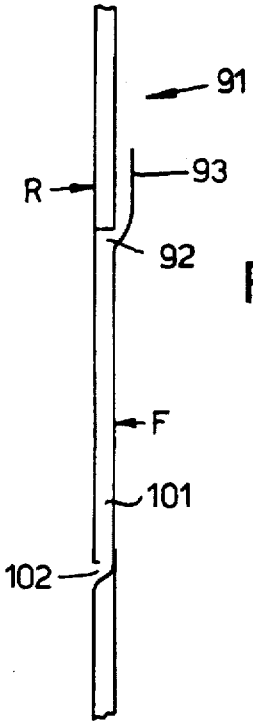
FIGS. 9A and 10 show a fifth embodiment of the invention.
Figure 9B:
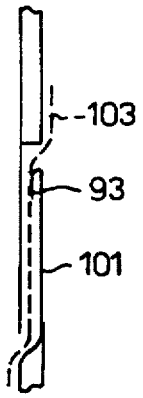
FIG. 9B shows a portion of the view of FIG. 9A in which a belt or web has been inserted in the cover through the slits.
Figure 10:
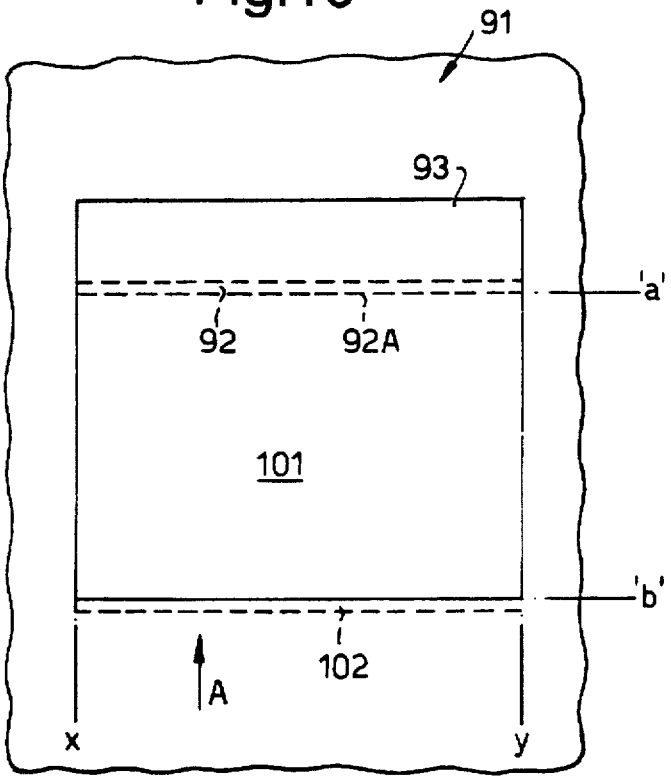

Referring to FIGS. 9A and 10, there is disclosed a portion 91 of a cover of similar construction to that disclosed in FIGS. 7A and 8. The double jersey fabric 91 includes a single jersey tube portion 101 which may have an open lower end 102 to the rear face R of the fabric. The single jersey tubular portion extends upwardly to a course-wise slit 92 formed at the upper end of the single jersey tube 91 and opens to the front face F of the fabric. The rear layer of the single jersey tube extends into the double jersey material. The lower edge 92A of the slit extends into a single jersey flap 93. The flap 93 can be tucked inside the tube 101 as shown in FIG. 9B. A belt or webbing 103, shown in dotted outline, can pass through the single jersey tube 101 and two slits 102, 92 as shown in FIG. 9B.

The double jersey fabric is knitted up to a predetermined course "b". At course "b" the stitches on the rear bed needles between needles x and y are pressed off or transferred to the front bed. The needles between x and y are then set up and further knitting continues with the needles outside of needles x and y knitting the double jersey fabric and the needles between x and y knitting a single jersey tube 101. This continues up to a predetermined course "a". At course "a" the needles outside of needles x and y and on the rear bed between x and y are held up while the needles between x and y on the front needle bed continue to knit to form the single jersey flap 93. The knitted stitches on the needles between x and y are then pressed off.

The front bed needles between x and y are then set up, and with the other previously held up needles continue to knit the double jersey fabric from course "a" onwards.

Figure 11:
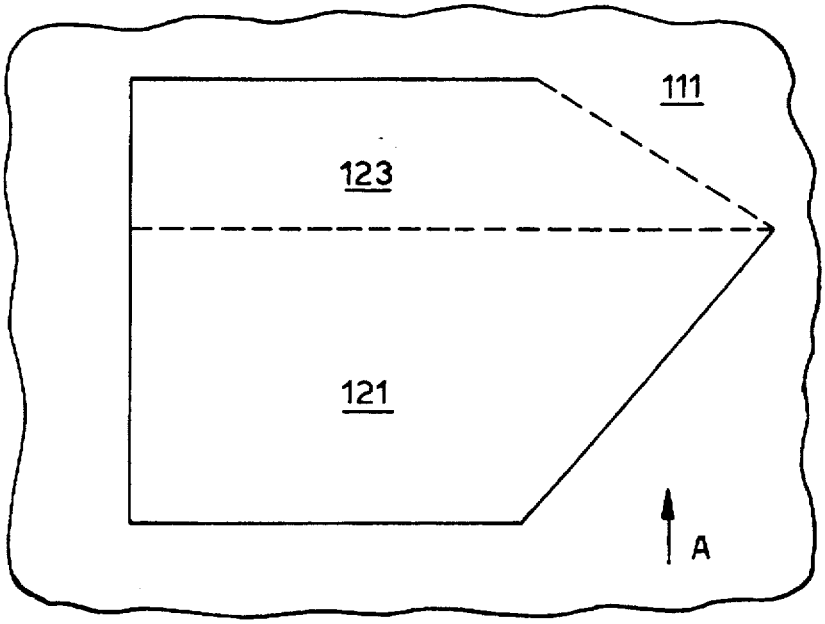
FIG. 11 shows a sixth embodiment of the invention.

Referring to FIG. 11, a portion of fabric 111 is shown which in structure is similar to that shown in FIGS. 9A and 10 except that the single jersey tube 121 increases in width progressively course by course, and the single jersey flap 123 decreases in width progressively course by course. This provides a disguised passageway for a webbing passing the cover at an acute angle to the wale-wise direction. One side of the single jersey tubular portion is formed along a particular predetermined wale line.

The embodiment shown in FIG. 11 is knitted as previously described for the embodiment in FIGS. 9A and 10 except that as the single jersey tubular portion 121 is knitted, the course-wise width of the robe is increased on a needle by course basis.

While this invention has been described in terms of certain preferred embodiments thereof, it will be appreciated that other forms could readily be adapted by one skilled in the art. Accordingly, the scope of this invention is to be considered limited only by the following claims.

What is claimed is:

1. A cover for an object in which the cover comprises double jersey weft knitted fabric having at least one course-wise slit having two edges formed in the fabric, at least one of said edges of the slit extending into an overlapping portion comprising further courses which overlap the other of said edges of the slit.

2. A cover as claimed in claim 1 wherein the overlapping portion comprises a plurality of courses of single jersey knitting.

3. A cover as claimed in claim 2 where each edge of said slit extends into single jersey knitting.

4. A cover as claimed in claim 3 wherein said course-wise slit is formed through aligned courses of both double jersey layers, in one of said layers the two edges of the slit extend into a pair of single jersey flaps which can be pushed through the slot formed in the other of said layers.

5. A cover as claimed in claim 3 wherein said course-wise slit is formed in aligned courses of both double jersey layers and the two edges of the slit each extend as a pair of flaps of single jersey tube construction, which flaps can be pushed through the slit.

6. A cover as claimed in claim 3 wherein said cover includes a single jersey tubular portion formed integrally with the double jersey cover in which the course-wise slit is formed in aligned courses in the single jersey tube and has one edge comprising the single jersey tube portion and the other edge comprising double jersey layers, and the flaps of single jersey tube construction extend one from each edge.

7. A cover as claimed in claim 2 in which the cover includes a single jersey tubular portion formed integrally with the double jersey cover and a portion of the single jersey tubular portion constitutes an edge of said course-wise slit.

8. A cover as claimed in claim 7 wherein one end of the tubular single jersey portion opens to one face of the double jersey fabric and the other end of the tubular single jersey portion opens to the other face of the double jersey fabric, said overlapping portion being at said one end of the tubular portion and being capable of being tucked within the tube portion.

9. A cover as claimed in claim 8 wherein said single jersey tube increases in width from said other end to said one end, and the overlapping portion decreases in width, allowing the overlapping portion to be tucked within the single jersey tube.

10. A method of forming a course-wise slit in a weft knitted fabric cover which is knitted on a weft knitting machine having needles displaced in at least two independently operable needle beds, the method comprising knitting the fabric on both needle beds in mainly double jersey construction and at a predetermined course selecting at least one group of consecutive needles on one or both needle beds and continuing to knit thereon while holding up needles on each side of said group to thereby form a flap, and then recommencing knitting on both needle beds to continue the double jersey construction from said predetermined course.

11. A method as claimed in claim 10 comprising pressing off said group of needles after knitting a plurality of courses to form said flap.

12. A method as claimed in claim 11 wherein at said predetermined course said selected group of needles on both needle beds continues to knit a double jersey construction flap, said group of needles picking up stitches on recommencing knitting from said predetermined course.

13. A method as claimed in claim 12 wherein on recommencing knitting, the needles on both needle beds knit double jersey fabric up to a second predetermined course where stitches on both groups of needles are pressed off, and both groups of needles then pick up new stitches and knit a plurality of courses while the needles on each side of said groups are held up to form a second flap, and then continuing to knit on all the needles after formation of said second flap.

14. A method as claimed in claim 11 wherein said fabric is knitted with said selected group of needles forming a single jersey tubular portion, and at the predetermined course said group of needles on one needle bed only continues to knit to form a single jersey construction flap with said other needles held up.

15. A method as claimed in claim 14 wherein at the recommencement of knitting said tubular portion, said group of needles on said one need bed are then dropped off and then set up as knitting is continued on both needle beds.

16. A method as claimed in claim 14 or claim 15 wherein the single jersey portion is knitted course-by-course on progressively increasing numbers of needles, and after said predetermined course the single jersey flap is knitted course-by-course on progressively decreasing numbers of needles.

17. A method as claimed in claim 16 wherein one side of the single jersey portion is formed along a single wale.

18. A method as claimed in claim 10 wherein at said predetermined course said selected group of needles on both needle beds continues to knit a single jersey robe to form a single jersey tubular loop which is subsequently separated along a course line to form a pair of single jersey tubular flaps with open ends.

19. A method as claimed in claim 17 wherein said fabric is knitted with said selected groups of needles forming a single jersey tubular portion which runs into the single jersey tubular loop.

20. A method as claimed in claim 10 wherein at said predetermined course for said group of needles, the stitches on one needle bed are dropped off and/or transferred to the other needle bed, and a single jersey loop is formed by knitting on said group of needles on the other needle bed, which loop is subsequently severed along a course line to form a pair of single jersey flaps.

21. A method as claimed in claim 20 wherein said group of needles on said one needle bed picks up stitches to knit a plurality of single jersey courses before continuing the double jersey knitting.

* * * * *